US009221278B2

(12) United States Patent
Ohnishi

(10) Patent No.: US 9,221,278 B2
(45) Date of Patent: Dec. 29, 2015

(54) INK JET RECORDING APPARATUS

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/381,990

(22) PCT Filed: Feb. 19, 2013

(86) PCT No.: PCT/JP2013/053907
§ 371 (c)(1),
(2) Date: Aug. 29, 2014

(87) PCT Pub. No.: WO2013/133001
PCT Pub. Date: Sep. 12, 2013

(65) Prior Publication Data

US 2015/0022601 A1 Jan. 22, 2015

(30) Foreign Application Priority Data

Mar. 8, 2012 (JP) ..... 2012-051251

(51) Int. Cl.
*B41J 2/01* (2006.01)
*B41J 11/00* (2006.01)
(Continued)

(52) U.S. Cl.
CPC ..... *B41J 11/0015* (2013.01); *B41J 2/32* (2013.01); *B41J 11/002* (2013.01); *B41J 11/04* (2013.01)

(58) Field of Classification Search
CPC ..... B41J 11/0015; B41J 11/002; B41J 11/04; B41J 2/32
USPC ..... 347/102
See application file for complete search history.

(56) References Cited

U.S. PATENT DOCUMENTS 5,041,846 A * 8/1991 Vincent et al. ..... 346/25
2002/0067401 A1 * 6/2002 Yraceburu et al. ..... 347/102
(Continued)

FOREIGN PATENT DOCUMENTS

CN 1043469 7/1990
CN 1652939 8/2005
(Continued)

OTHER PUBLICATIONS

"International Search Report (Form PCT/ISA/210)", mailed on Mar. 26, 2013, pp. 1-4, in which five of the listed references (JP2010-030313, JP2011-202117, JP2009-509005, JP2008-155485 and JP2006-272731) were cited.
(Continued)

*Primary Examiner* — Stephen Meier
*Assistant Examiner* — Alexander D Shenderov
(74) *Attorney, Agent, or Firm* — Jianq Chyun IP Office

(57) ABSTRACT

An ink jet recording apparatus is provided and includes: a carriage on which a recording head for discharging ink droplets onto the recording medium is mounted and that moves relative to the recording medium; a platen that supports the recording medium at a predetermined position; and heating means for heating the recording medium, in which heating means includes a platen heater that is mounted on the platen and heats the recording medium from a lower side of the recording medium, a carriage heater that is mounted on the carriage and heats the recording medium from an upper side of the recording medium, and an upper heater that is disposed on a downstream side of the carriage in a moving direction of the recording medium and heats the recording medium from the upper side of the recording medium.

4 Claims, 7 Drawing Sheets

(51) Int. Cl.
*B41J 2/32* (2006.01)
*B41J 11/04* (2006.01)

(56) References Cited

U.S. PATENT DOCUMENTS

| | | | | |
|---|---|---|---|---|
| 2008/0024557 | A1* | 1/2008 | Moynihan | 347/56 |
| 2010/0066783 | A1* | 3/2010 | Navazo et al. | 347/17 |

FOREIGN PATENT DOCUMENTS

| | | |
|---|---|---|
| JP | H02-034338 | 2/1990 |
| JP | H02-182461 | 7/1990 |
| JP | 2004-330569 | 11/2004 |
| JP | 2006-272731 | 10/2006 |
| JP | 2008-155485 | 7/2008 |
| JP | 2009-509005 | 3/2009 |
| JP | 2010-030313 | 2/2010 |
| JP | 4429923 | 3/2010 |
| JP | 2011-202089 | 10/2011 |
| JP | 2011-202117 | 10/2011 |

OTHER PUBLICATIONS

"Office Action of China Counterpart Application", issued on May 5, 2015, pp. 1-15, with English translation thereof, in which the listed references were cited.
"Office Action of Japan Counterpart Application", issued on Aug. 25, 2015, p1-p11, with English translation thereof, in which the listed references were cited.

* cited by examiner

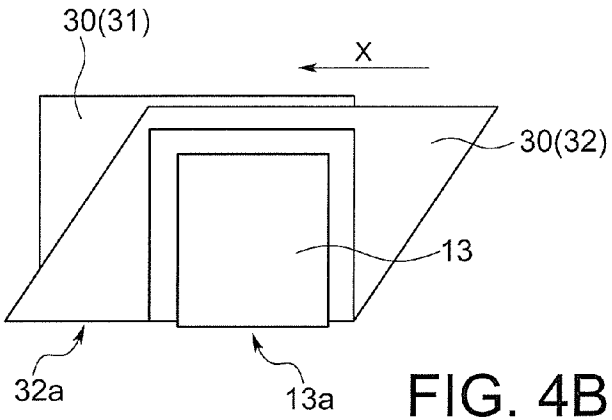
FIG. 4A
FIG. 4B
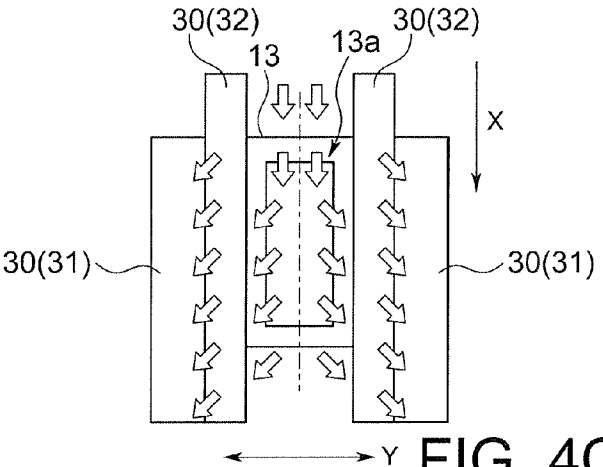
FIG. 4C
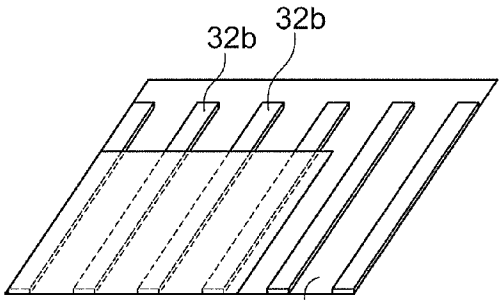
FIG. 4D

INK JET RECORDING APPARATUS

CROSS-REFERENCE TO RELATED APPLICATION

This application is a 371 application of an international PCT application serial no. PCT/JP2013/053907, filed on Feb. 19, 2013, which claims the priority benefit of Japan application no. 2012-051251, filed on Mar. 8, 2012. The entirety of each of the above-mentioned patent applications is hereby incorporated by reference herein and made a part of this specification.

TECHNICAL FIELD

The present invention relates to an ink jet recording apparatus and specifically relates to an ink jet recording apparatus which records diagrams or characters composed of plural ink dot arrays onto a recording medium by ejecting ink thereon.

BACKGROUND ART

In an ink jet recording apparatus in which an ink containing an organic solvent as a major component is ejected, there is a problem in that diagrams or characters composed of plural ink dot arrays which are printed onto a surface of a recording medium are smeared or blurred by, for example, the ejected ink droplets widely infiltrating into the recording medium around ink-landing positions.

As a technique to solve such a problem, an ink jet recording apparatus is known, the ink jet recording apparatus including a heater for heating a recording medium, in which the smearing of ink droplets that land on a surface of a recording medium is prevented by drying the ink droplets at an early stage (refer to Patent Literature 1).

CITATION LIST

Patent Literature

Patent Literature 1: Japanese Patent No. 4429923

SUMMARY OF THE INVENTION

Technical Problem

As the above-described ink used in the ink jet recording apparatus of the related art, an organic solvent-based ink is used. Therefore, a recording head is not provided with heating means, and ink that lands on a recording medium is dried by heating the recording medium from a lower side of the recording medium using a heater (platen heater) provided in a platen so as to be in a temperature range of 40 (° C.) to 80 (° C.).

However, for example, in a case where a hard-to-dry ink is used such as an ink (hereinafter, also referred to as "latex ink") which is composed of an aqueous ink vehicle containing latex as a binder resin and having a moisture content of 35 (wt %) or greater, a case where a recording speed is high, or a case where a non-absorbent recording medium which is not coated with a coating agent as an ink absorbing layer is used, there is a problem in that ink that lands on the recording medium cannot be completely dried at a heating temperature of 40 (° C.).

In addition, the above-described latex ink has a hard-to-dry property and, once forming a coating film, has a hard-to-redissolve property. Accordingly, in order to avoid a problem of non-discharge caused by the clogging of nozzles of a recording head, it is necessary that a drying temperature at a printing area (area directly below the recording head or peripheral area thereof) be decreased. On the other hand, when the drying temperature at the printing area is decreased, there is a problem in that the concentration of a solvent remaining in the latex ink on the recording medium is increased due to insufficient drying.

In addition, for example, when a recording medium is heated from only an upper side of the recording medium, intense heating is necessary, and thus a coating film is formed on an ink surface. As a result, there is a problem in that a solvent cannot be volatilized or is hard to dry.

The present invention has been made in consideration of the above-described problems, and an object thereof is to provide an ink jet recording apparatus capable of preventing the smearing of ink that lands on a recording medium and completely drying the ink, for example, even in a case where a hard-to-dry ink is used such as an ink which is composed of an aqueous ink vehicle containing latex as a binder resin, a case where a recording speed is high, or a case where a non-absorbent recording medium which is not coated with a coating agent as an ink absorbing layer is used. Further, another object of the present invention is to provide an ink jet recording apparatus capable of preventing nozzles of a recording head from being dried to suppress ink non-discharge.

Solution to Problem

According to an embodiment of the present invention, the above-described problems can be solved by solving means disclosed below.

Disclosed is an ink jet recording apparatus that prints an image onto a recording medium using an ink which is composed of an aqueous ink vehicle containing latex as a binder resin, the ink jet recording apparatus including: a carriage on which a recording head for discharging ink droplets onto the recording medium is mounted and that moves relative to the recording medium; a platen that supports the recording medium at a predetermined position; and a heating means for heating the recording medium, in which the heating means includes a platen heater that is mounted on the platen and heats the recording medium from a lower side of the recording medium, a carriage heater that is mounted on the carriage and heats the recording medium from an upper side of the recording medium, and an upper heater that is disposed on a downstream side of the carriage in a moving direction of the recording medium and heats the recording medium from the upper side of the recording medium. According to this configuration, even in a case where an ink which is composed of an aqueous ink vehicle containing latex as a binder resin is used, the recording medium can be heated by the heating means such that the surface temperature of the recording medium directly below the recording head for discharging ink droplets is in a desired temperature range (for example, 60 (° C.) to 80 (° C.)). Therefore, the smearing of ink that lands on the recording medium can be prevented and can be completely dried. The above-described effect can also be obtained in a case where a recording speed is high or a case where a non-absorbent recording medium which is not coated with a coating agent as an ink absorbing layer is used.

For example, when the recording medium is heated by using only the heater (carriage heater) mounted on the carriage, the nozzles of the recording head mounted on the carriage are dried, which may cause ink non-discharge. Alternatively, when the recording medium is heated by using only the heater (platen heater) mounted on the platen, cockling (rippling effect) or melting may occur depending on the type (material) of the recording medium. On the other hand, as in the configuration of the present invention, by heating the recording medium from the upper and lower sides of the recording medium using the three heaters (the platen heater, the carriage heater, and the upper heater), the heating temperature of each heater can be reduced. Therefore, the above-described problems, that is, ink non-discharge or defects (cockling or melting) of the recording medium can be solved.

More specifically, since the platen heater and the upper heater are provided, the heating of the carriage heater can be set to be weak. Further, a solvent can be smoothly moved to an ink surface by heating emulsion particles of the latex ink from a lower side thereof using the platen heater. More specifically, since the internal temperature of the landing ink droplets is high at a lower portion thereof and is low at an upper portion thereof, the solvent inside the ink droplets can be smoothly moved from the lower portion to the upper portion. When the recording medium is heated by only the carriage heater, contrary to the above-described case, the internal temperature distribution of ink droplets is low at a lower portion thereof and is high at an upper portion thereof. Therefore, the solvent cannot be smoothly moved from the lower portion to the upper portion. Further, there may be a problem in that a coating film is likely to be formed on an ink surface. According to the present invention, in particular, a printed area of the recording medium can be intensely heated by the upper heater. That is, since the intense heating at the printed area can be secured, the effect capable of weakening the heating of the carriage heater (decreasing the drying temperature at the printed area) can be obtained. As a result, complete drying can be realized in printing in which the latex ink is used, and a remarkable effect capable of preventing the nozzles of the recording head from being dried to suppress ink non-discharge can be obtained.

In addition, according to the present invention, it is preferable that the ink jet recording apparatus further include a controller that controls a heating temperature of the heating means, in which the controller controls the heating means such that a surface temperature of the recording medium directly below the recording head is in a range of 60 (° C.) to 80 (° C.). According to this configuration, the recording medium can be heated from the upper and lower sides of the recording medium using the three heaters (the platen heater, the carriage heater, and the upper heater) such that the surface of the recording medium is in a heating temperature range of 60 (° C.) to 80 (° C.). As a result, the heating temperature of each heater can be reduced, and thus, particularly, defects (cockling or melting) of the recording medium can be efficiently prevented.

In addition, according to the present invention, it is preferable that a vinyl chloride-based film which is not coated with a coating agent as an ink absorbing layer be used in the recording medium.

The reason is that the vinyl chloride-based film has a problem in that the normal heat-resistant temperature is lower than that of other films (for example, PET). More specifically, for example, when a recording medium is heated by using only the platen heater, there is a problem in that cockling (rippling effect) or melting is likely to occur. On the other hand, as in the above-described configuration, by heating the recording medium from the lower and upper sides of the recording medium using the three heaters (the platen heater, the carriage heater, and the upper heater), the heating temperature of each heater can be reduced. Therefore, problems such as defects (cockling or melting) of the recording medium can be solved, and the vinyl chloride-based film can be used. Accordingly, choices of a material which can be used as the recording medium can be increased. In addition, since the recording medium in which an ink absorbing layer is not provided can be used, the cost can be reduced.

In addition, according to the present invention, it is preferable that the platen heater include at least one of a print heater that is disposed directly below the recording head, a pre-heater that is disposed on an upstream side of the print heater in the moving direction of the recording medium, and a post-heater that is disposed on a downstream side of the print heater in the moving direction of the recording medium. According to this configuration, for example, when the pre-heater is provided, the recording medium can be pre-heated by the pre-heater. Therefore, even when an image is printed at a low room temperature or at a high speed, an effect in which it is not necessary to increase the temperature of the heaters (that is, the print heater and the carriage heater) at a printing area can be obtained. In addition, for example, when the post-heater is provided, the recording medium can be heated by the post-heater after printing. Therefore, an effect in which it is not necessary to increase the temperature of the heaters (that is, the print heater and the carriage heater) at a printing area can be obtained.

Advantageous Effects of Invention

According to the disclosed ink jet recording apparatus, the smearing of ink that lands on a recording medium can be prevented, and the ink can be completely dried even in a case where a hard-to-dry ink is used such as an ink which is composed of an aqueous ink vehicle containing latex as a binder resin, a case where a recording speed is high, or a case where a non-absorbent recording medium which is not coated with a coating agent as an ink absorbing layer is used. In addition, nozzles of a recording head can be prevented from being dried to suppress ink non-discharge.

BRIEF DESCRIPTION OF THE DRAWINGS

FIGS. 4A to 4D are enlarged diagrams (schematic diagrams) illustrating the periphery of a recording head of the ink jet recording apparatus of FIG. 3.

DESCRIPTION OF EMBODIMENTS

Figure 1:
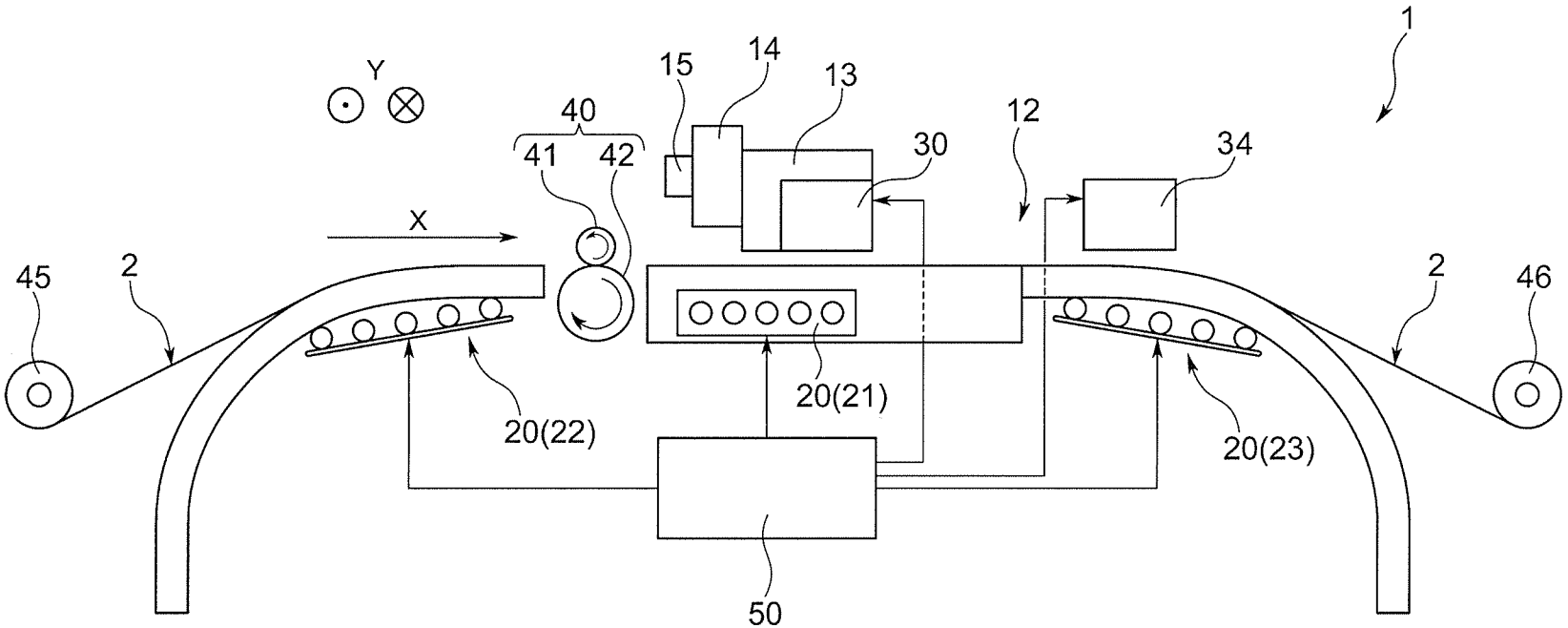
FIG. 1 is a schematic diagram illustrating an example of an ink jet recording apparatus according to a first embodiment of the present invention.

Hereinafter, embodiments of the present invention will be described in detail with reference to the accompanying drawings. In all the drawings illustrating the embodiments, members having the same function are represented by the same reference numerals, and the description thereof will not be repeated in some cases.

First Embodiment

Figure 2:
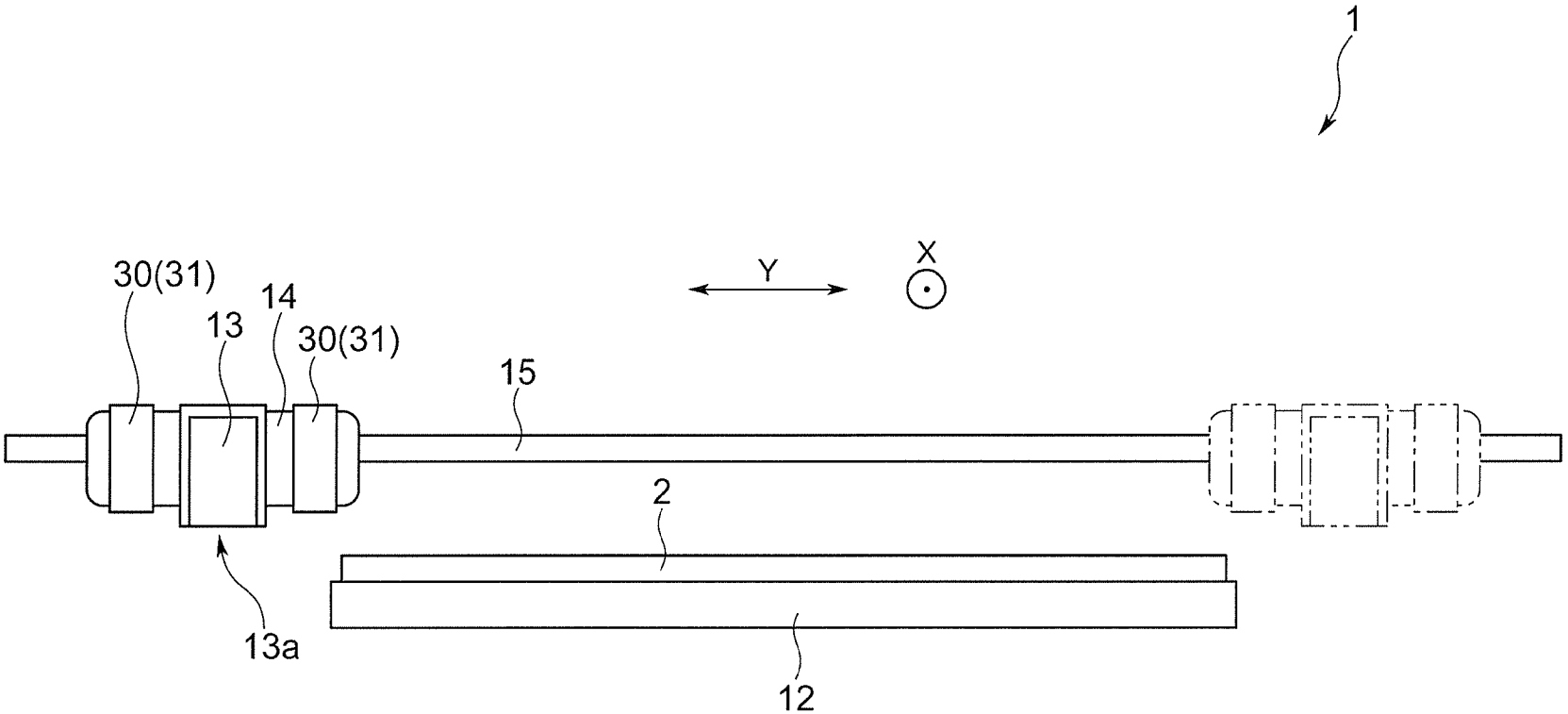
FIG. 2 is a schematic diagram illustrating the example of the ink jet recording apparatus according to the first embodiment of the invention.

FIGS. 1 and 2 are schematic diagrams illustrating a configuration example of an ink jet recording apparatus 1 according to a first embodiment of the present invention, in which FIG. 1 is a diagram illustrating the ink jet recording apparatus 1 when seen from a direction (Y direction in the drawing) perpendicular to a moving direction (X direction in the drawing) of a recording medium, and FIG. 2 is a diagram illustrating the ink jet recording apparatus 1 when seen from the moving direction (X direction in the drawing) of the recording medium.

The ink jet recording apparatus 1 according to the embodiment includes: a platen (support body) 12 that supports a recording medium 2; a recording head 13 that ejects ink from plural discharge ports onto a surface of the recording medium 2 to land thereon while reciprocating in the direction (Y direction) perpendicular to the moving direction of the recording medium 2; a carriage 14 on which the recording head 13 is mounted and that is supported by a guide rail 15 so as to reciprocate in the Y direction; carrying means 40 for carrying the recording medium 2; and a controller 50 that controls the operation of each component in the apparatus.

For example, the recording medium 2 is supported by the platen 12 and is interposed between carrying rollers 41 and 42 included in the carrying means 40. In addition, once the travelling of the recording head 13 from one end to the other end of the recording medium 2 in the Y direction is finished while ejecting ink droplets, the carrying rollers 41 and 42 rotate, which carries the recording medium 2 in the X direction.

In addition, in a rear portion of the platen 12, unwinding means 45 for supporting the recording medium 2, which is wound in a roll shape, so as to be unwound is provided.

Further, in a front portion of the platen 12, winding means 46 for winding the printed recording medium 2, which is to be carried forward from the platen 12, in a roll shape is provided.

In this case, the recording head 13 has a structure in which ink droplets are ejected from nozzles (not illustrated) disposed parallel to a lower surface (nozzle surface 13*a*) of the recording head 13 using a piezoelectric method or the like. In addition, the recording head 13 is fixed to the carriage 14 supported by the guide rail 15 and can move in the Y direction through driving means (not illustrated). The driving means is configured by, for example, an electric motor, a driving belt, and an electronic circuit.

Regarding the nozzles of the recording head 13, for example, 8 nozzle arrays, each of which is formed by 180 discharge nozzles being aligned in a line in the X direction, are formed in parallel in the Y direction (not illustrated). The ink discharge control of each discharge nozzle is performed through a control signal which is output from the controller 50 to the recording head 13.

As an example of the recording medium 2, a vinyl chloride-based film which is not coated with a coating agent as an ink absorbing layer is used. In the ink jet recording apparatus according to the embodiment, as described below, by heating the recording medium 2 from the upper and lower sides of the recording medium 2 using three heaters (a platen heater 20, a carriage heater 30, and an upper heater 34), the heating temperature of each heater can be reduced. Therefore, defects (cockling or melting) of the recording medium 2 can be solved, and the vinyl chloride-based film can be used. Accordingly, choices of a material which can be used as the recording medium 2 can be increased. In addition, since the recording medium 2 in which an ink absorbing layer is not provided can be used, the cost can be reduced. However, the recording medium 2 is not limited to the vinyl chloride-based film, and use of paper, fabric, or film-shaped resin materials such as polyethylene-based films, polyester-based films, polyolefin-based films, polypropylene-based films, or polycarbonate films can be considered. Further, a configuration in which an ink absorbing layer is provided in these film-shaped resin materials can be considered.

In addition, in the ink jet recording apparatus 1 according to the embodiment, for example, an ink which is composed of an aqueous ink vehicle containing latex as a binder resin is used. The aqueous ink vehicle described herein is obtained by adding a resin (in this embodiment, latex as a binder resin) to a solvent (water or a mixed solution of water and an aqueous solvent), and the ink is obtained by adding a colorant, that is, a pigment, a dye, or the like to the aqueous ink vehicle. To the aqueous ink vehicle, optionally, a predetermined additive such as a preservative is added. The ink is hard to dry and thus has a problem in that drying is too slow particularly for an industrial ink jet recording apparatus in which a recording speed is high. That is, there are problems in that smearing occurs due to insufficient drying or ink is transferred to a back side of a recording medium when the recording medium is wound. Accordingly, in order to use the ink in an industrial ink jet recording apparatus in which a recording speed is high, it is necessary that the heating temperature of the recording medium be controlled such that the surface temperature of the recording medium is in a range of 60 (° C.) to 80 (° C.).

Meanwhile, examples of the resin include water-soluble vinyl-based resins, acrylic resins, alkyd-based resins, polyester-based resins, polyurethane-based resins, silicon-based resins, fluororesins, epoxy-based resins, phenoxy-based resins, polyolefin-based resins, and modified resins thereof. Among these, acrylic resins, water-soluble polyurethane-based resins, water-soluble polyester-based resins, and water-soluble acrylic resins are more preferable, and acrylic resins are particularly preferable.

The ink jet recording apparatus 1 according to the embodiment is provided with a heating means for heating ink droplets that land on the surface of the recording medium 2 to volatilize and remove the solvent contained in the ink. The heating temperature of the recording medium 2 which is heated by the heating means is controlled by the controller 50. The controller 50 has a configuration in which a sensor (not illustrated) which detects a heat radiation temperature of the heating means, an electronic circuit (not illustrated) which controls the heat radiation temperature, and the like are combined.

In an ink jet recording apparatus of the related art, typically, under the assumption that an ink containing an organic solvent as a major component is used, a combination of two or three among platen heaters that are provided in a platen, or one print heater is arranged, the platen heaters including: a pre-heater for drying and pre-heating; a print heater that is provided at a position of a print head; and a post-heater for post-heating.

However, in a case where an ink having a low drying speed is used or a case where an apparatus having a high recording speed is used, heat for evaporating an ink composition from the surface of the recording medium cannot be sufficiently supplied only by heating the recording medium from the platen, that is, from a back surface of the recording medium. Therefore, the ink that lands on the surface of the recording medium cannot be completely dried. In addition, when only the temperature of a back surface heater is increased, there is a problem in that ink discharge failure is caused by thermal deformation of the recording medium or by condensation of evaporated ink on a nozzles surface of a recording head. In particular, in a case where an ink of which a drying speed is decreased by a coating film being formed on the ink surface along with the progress of drying is used such as an ink which is composed of an aqueous ink vehicle containing latex as a binder resin, it is difficult to solve the above-described problems with only the heating means for heating the recording medium from the back surface of the recording medium such as the platen heater of the related art.

On the other hand, in the ink jet recording apparatus 1 according to the embodiment, the heating means includes three heaters for heating the recording medium 2 from the upper and lower sides of the recording medium 2. More specifically, the heating means includes a platen heater 20 that is mounted on the platen 12 and heats the recording medium 2 from a lower side of the recording medium 2, a carriage heater 30 that is mounted on the carriage 14 and heats the recording medium 2 from an upper side of the recording medium 2, and an upper heater 34 that is disposed on a downstream side of the carriage 14 in a moving direction (X direction in the drawing) of the recording medium 2 and heats the recording medium 2 from the upper side of the recording medium 2. In the embodiment, the controller 50 can control the platen heater 20, the carriage heater 30, and the upper heater 34 such that the surface temperature of the recording medium 2 directly below the recording head 13 for discharging ink droplets onto the recording medium 2 is in a desired temperature range (for example, 60° C. to 80° C.).

Hereinafter, a specific configuration example of the heating means will be described.

First, as illustrated in FIG. 1, as the platen heater 20, a print heater 21 that is disposed directly below the recording head 13 is provided. In addition to the print heater 21, as the platen heater 20, a pre-heater 22 and a post-heater 23 are provided on upstream and downstream sides of the print heater 21 in a relative moving direction between the recording medium 2 and the recording head 13, respectively. In FIG. 2, only the platen 12 is illustrated, and the platen heater 20 is not illustrated (the same shall be applied to FIGS. 3, 6, and 7).

In the platen heater 20, that is, in the print heater 21, the pre-heater 22, and the post-heater 23, for example, an electric heater using ceramic or nichrome wire is used. The pre-heater 22 is disposed inside a rear portion (rear side in the moving direction of the recording medium 2) of the platen 12 and conducts heat, which is radiated from the pre-heater 22, to the recording medium 2, which is carried onto the rear portion of the platen 12, through the platen 12 to exhibit an action of preliminarily heating the recording medium 2.

The print heater 21 is disposed inside a center portion of the platen 12 and conducts heat, which is radiated from the print heater 21, to the recording medium 2, which is carried onto the center portion of the platen 12, through the platen 12 to exhibit an action of heating the recording medium 2 to dry ink that lands on the recording medium 2.

The post-heater 23 is disposed inside a front portion (front side in the moving direction of the recording medium 2) of the platen 12 and conducts heat, which is radiated from the post-heater 23, to the recording medium 2, which is carried onto the front portion of the platen 12, through the platen 12 to exhibit an action of heating the recording medium 2 to dry ink that lands on the recording medium 2.

In particular, since the recording medium 2 can be heated by the pre-heater 22 provided at a non-printed area, the heating of the carriage heater 30 can be weakened (the drying temperature at a printing area can be decreased).

In addition, the recording medium 2 can be intensely heated by the post-heater 23 (and the upper heater 34) that is provided at a printed area. As a result, the heating of the carriage heater 30 can be weakened (the drying temperature at a printing area can be decreased). Therefore, the formation of a coating film on an ink surface can be suppressed.

In addition, the heating of the carriage heater 30 can be set to be relatively weak, and the heating of the print heater 21 can be set to be relatively strong. As a result, the internal temperature distribution of the landing ink droplets can be controlled to be high at a lower portion thereof and to be low at an upper portion thereof by heating emulsion particles of the latex ink from a lower side thereof using the print heater 21. Therefore, the solvent inside the ink droplets can be smoothly moved from the lower portion to the upper portion.

Accordingly, complete drying can be realized in printing in which the latex ink is used, and an effect capable of preventing the nozzles of the recording head 13 from being dried to suppress ink non-discharge can be obtained. Even when intense heating is performed by the above-described heater at the printed area, it is difficult for a solvent to remain because the leveling of the printing surface has been already performed, and the solvent present in lower portions of resin particles moves to surfaces thereof.

In the embodiment, the controller 50 has a configuration capable of controlling the heating temperatures of the print heater 21, the pre-heater 22, and the post-heater 23 independently of each other. As a result, the heating temperature of the recording medium 2 pre-heated by the pre-heater 22, the heating temperature of the recording medium 2 heated by the print heater 21, and the heating temperature of the recording medium 2 heated by the post-heater 23 can be accurately controlled, respectively depending on the type of the recording medium 2, the thickness thereof, and the like.

In a modification example of the platen heater 20, a configuration can be considered in which the print heater 21 is provided, and either or both of the pre-heater 22 and the post-heater 23 are not provided. Alternatively, in another modification example, a configuration can be considered in which the print heater 21 is not provided, and either or both of the pre-heater 22 and the post-heater 23 are provided.

In addition, as illustrated in FIG. 1, as the carriage heater 30, a heater (in the present application, collectively called "infrared heater") 31 that is arranged in the carriage 14 opposite to the recording medium 2 and irradiates infrared rays or far infrared rays to heat the recording medium 2 is provided.

In addition, as illustrated in FIG. 1, the ink jet recording apparatus 1 is provided with the upper heater 34. For example, a configuration can be considered in which, as the upper heater 34, an infrared heater that has a shape longer than the width of the recording medium 2 from one end to the other end in the Y direction and irradiates infrared rays or far infrared rays is used. A fixing structure of the infrared heater to the apparatus is not particularly limited, and the infrared heater may be appropriately fixed according to the configuration of the apparatus.

According to this configuration, the recording medium can be intensely heated by the upper heater 34 (and the post-heater 23) that is provided at a printed area. As a result, the heating of the carriage heater 30 can be weakened (the drying temperature at a printing area can be decreased). Therefore, the formation of a coating film on an ink surface can be suppressed.

In addition, the heating of the carriage heater 30 can be set to be relatively weak, and the heating of the print heater 21 can be set to be relatively strong. As a result, the internal temperature distribution of the landing ink droplets can be controlled to be high at a lower portion thereof and to be low at an upper portion thereof by heating emulsion particles of the latex ink from a lower side thereof using the print heater 21. Therefore, the solvent inside the ink droplets can be smoothly moved from the lower portion to the upper portion.

Accordingly, complete drying can be realized in printing in which the latex ink is used, and an effect capable of preventing the nozzles of the recording head 13 from being dried to suppress ink non-discharge can be obtained. Even when intense heating is performed by the above-described heater at the printed area, it is difficult for a solvent to remain because the leveling of the printing surface has been already performed, and the solvent present in lower portions of resin particles moves to surfaces thereof.

Hereinafter, an example of a method of controlling the heating means using the controller 50 will be described.

First, it is preferable that drying conditions of the platen heater 20 be fixed irrespective of an atmosphere temperature such as a room temperature. In this embodiment, for convenience of description, a case where the carriage heater 30 and the platen heater 20 (only the print heater 21) are provided will be described as an example. However, the description can be applied to a case where the pre-heater 22, the post-heater 23, and the like are further provided.

Meanwhile, the infrared heater 31 as the carriage heater 30 has an effect of promoting the evaporation of a solvent (medium) and increasing the drying speed by rapidly heating the ink in which the surface temperature of the recording medium 2 is likely to be decreased by evaporation. However, excessive heating causes damages such as deformation of the recording medium 2 and thus needs to be avoided. In this case, when a heating temperature of the platen heater 20 alone is represented by T1, and when a temperature of the recording medium 2 which is heated to be higher than T1 by a combination of the platen heater 20 and the carriage heater 30 (in this case, the infrared heater 31) is represented by ΔT2, a temperature T12 of the recording medium 2 which is heated by a combination of the platen heater 20 and the carriage heater 30 can be obtained from the following expression.

$$T12=T1+\Delta T2$$

In the embodiment, the temperature T12 of the recording medium 2 which is heated by the combination of the platen heater 20 and the carriage heater 30 is controlled to be substantially fixed irrespective of a room temperature Tr. According to this configuration, the recording medium 2 can be completely dried irrespective of the room temperature Tr.

More specifically, first, the temperature T1 of the platen heater 20 (≅the temperature of the recording medium 2 immediately before being printed) is set to a fixed temperature which is determined based on a relationship between the type of the solvent of the ink and the heat-resistance of the recording medium 2 irrespective of the room temperature Tr. It is preferable that a value of T1 which is not affected by the room temperature Tr be sufficiently higher than the room temperature Tr. Therefore, the value of T1 is set to be in a range of for example, T1=35 (° C.) to 80 (° C.). As the temperature T1 is increased, the drying speed of the recording medium 2 is increased. However, from the viewpoints of the heat-resistance of the recording medium 2, the safety of the operator, and energy saving, it is preferable that the temperature T1 be set to be as low as possible under conditions that the ink can be dried. In the embodiment, since the recording medium 2 is heated by the platen heater 20 and the carriage heater 30, it is preferable that T1 be set to a temperature which is higher than the temperature Tr by at least 20 (° C.) and is higher than ΔT2 by at least 10 (° C.), that is, T1=25 (° C.) to 60 (° C.). For example, it is preferable that the temperatures be set such that T1=40 (° C.), ΔT2=20 (° C.) to 30 (° C.), and T12=T1+ΔT2=60 (° C.) to 80 (° C.).

In this way, by setting the temperature T1 of the print heater to be sufficiently higher than the room temperature Tr, defects can be solved. For example, even when the heating temperature is set based on the room temperature Tr, the drying speed does not change depending on the room temperature.

Further, it is preferable that the heating temperature ΔT2 of the carriage heater 30 (in the embodiment, the infrared heater 31) be controlled to be changed depending on the recording speed on the recording medium without being based on the room temperature Tr.

More specifically, it is preferable that ΔT2 be controlled to be changed depending on a change in an area velocity Vs which is determined based on a slide scanning speed Vy of the recording head 13 in the Y direction and a carrying speed Vx of the recording medium in the X direction. In the embodiment, when Vs is decreased, the heating time of the carriage heater 30 (infrared heater 31) is increased, and the recording medium is damaged due to overheating. Conversely, when Vs is increased, ΔT2 is decreased along with a decrease in drying time, and the drying speed is decreased. Therefore, a configuration can be considered in which electric power for heating the infrared heater 31 as the carriage heater 30 be controlled depending on a recording mode, that is, depending on a recording speed such that ΔT2 is in a range higher than a given value not to decrease the drying speed due to an increase in Vs and to increase the drying speed. According to an experiment by the present inventors, the value of ΔT2 is changed depending on the type of the main solvent (medium) of the ink, and a result of completely drying the ink can be obtained when the value of ΔT2 is selected in a range of 5(%) to 50(%) of a melting point value of the solvent. Accordingly, the value of ΔT2 is preferably in a range of 10(%) to 20(%).

Next, regarding the operation of the ink jet recording apparatus 1 including the above-described configuration, in particular, a drying action will be mainly described.

First, the recording medium 2, which is supported by the unwinding means 45 provided on the rear portion of the platen 12 and is wound in a roll shape, is carried by the carrying means 40 to a lower side of a travelling path of the recording head 13 and carried from a rear portion of the platen 12 to a front side thereof. At this time, the recording medium 2, which is carried from the rear portion of the platen 12 to the lower side of the travelling path of the recording head 13, is heated by the pre-heater 22 to be in a state of being preliminarily warmed. The pre-heater 22 effectively acts when the recording medium 2 carried to the center portion of the platen 12 cannot be heated to a sufficient temperature only with the print heater 21 in a case where the recording medium 2 is thick, a case where a peripheral temperature around the ink jet recording apparatus 1 is low, or the like.

Next, the recording medium 2 is heated by the print heater 21 and the carriage heater 30, in which the recording medium 2 is carried from the rear portion of the platen 12 onto the center portion of the platen 12 of the lower side of the travelling path of the recording head 13, is warmed in advance by the pre-heater 22, and is carried to the center portion of the platen 12 on which ink droplets ejected from nozzles (not illustrated) of the recording head 13 land. As described above, it is preferable that the recording medium 2 be heated such that the surface temperature of the recording medium 2 directly below the recording head 13 for discharging ink droplets onto the recording medium 2 is in a range of 60 (° C.) to 80 (° C.).

In the embodiment, by heating the recording medium 2 from the upper and lower sides of the recording medium 2 using the three heaters (the platen heater 20, the carriage heater 30, and the upper heater 34), the heating temperature of each heater can be reduced. Therefore, the cockling or melting of the recording medium 2 can be prevented, and the recording medium 2 can be accurately heated at all times without underheating and overheating irrespective of the room temperature.

Next, droplets of ink (in the embodiment, the ink which is composed of an aqueous ink vehicle containing latex as a binder resin) ejected from the nozzles (not illustrated) of the recording head 13 land on the surface of recording medium 2 which is accurately heated such that the surface temperature is in a desired temperature range of 60 (° C.) to 80 (° C.).

In the embodiment, by using the carriage heater 30 (infrared heater 31), the platen heater 20, and the upper heater 34, the above-described ink droplets that land on the surface of the recording medium 2 do not widely infiltrate into the recording medium 2 around ink-landing positions and can be rapidly dried without pausing in a state where the ink droplets are fixed onto the ink-landing positions in a small-diameter dot shape. Accordingly, clear diagrams or characters composed of plural ink dot arrays and having no smearing can be recorded on the surface of the recording medium 2.

In this way, the recording medium 2 on which diagrams or characters are recorded is carried by the carrying means 40 from the center portion of the platen 12 to the front portion of the platen 12 and is wound in a roll shape by the winding means 46 of the front portion of the platen 12.

As described above, according to the embodiment having the above-described configuration, the smearing of ink that lands on a recording medium can be prevented, and the ink can be completely dried even in a case where a hard-to-dry ink is used such as an ink which is composed of an aqueous ink vehicle containing latex as a binder resin, a case where a recording speed is high, or a case where a non-absorbent recording medium which is not coated with a coating agent as an ink absorbing layer is used.

Further, the heating of the carriage heater 30 can be weakened (the drying temperature at a printing area can be decreased). In addition, the internal temperature distribution of the landing ink droplets can be controlled to be high at a lower portion thereof and to be low at an upper portion thereof by relatively intensely heating the recording medium 2 from the lower side of the recording medium 2. Therefore, complete drying can be realized in printing in which the latex ink is used, and an effect capable of preventing the nozzles of the recording head 13 from being dried to suppress ink non-discharge can be obtained.

Second Embodiment

Next, an ink jet recording apparatus 1 according to a second embodiment of the present invention will be described.

The ink jet recording apparatus 1 according to the second embodiment has the same basic configuration as that of the ink jet recording apparatus 1 according to the first embodiment and has different points therefrom particularly in a configuration of the heating means. Hereinafter, the embodiment will be described focusing on the different points.

Figure 3:
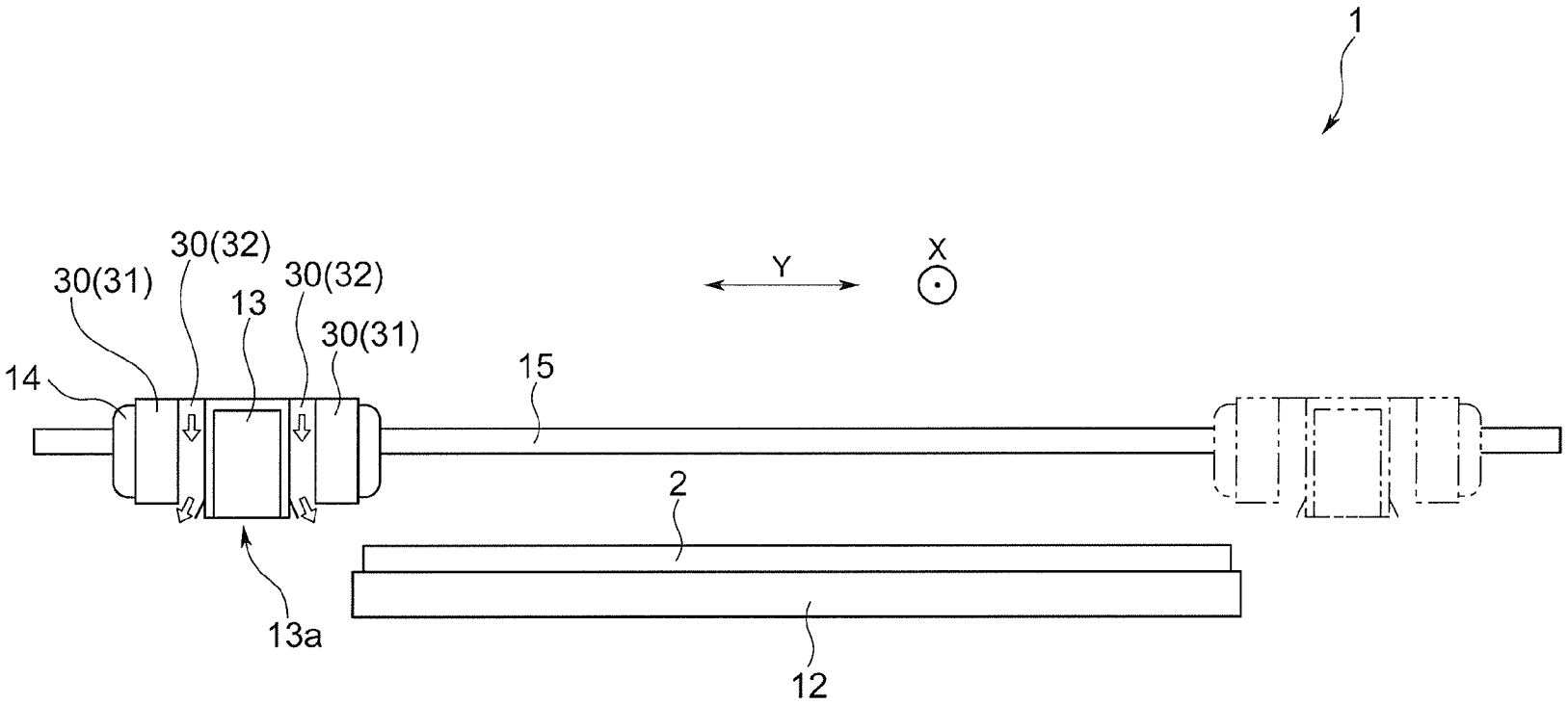
FIG. 3 is a schematic diagram illustrating an example of an ink jet recording apparatus according to a second embodiment of the present invention.

As illustrated in FIG. 3, in the embodiment, as the carriage heater 30 included in the heating means, both the infrared heater 31 and a warm-air heater 32 are provided at each of both ends of the recording head 13 mounted on the carriage 14. Although not illustrated, the platen heater 20 and the upper heater 34 are also provided similarly to the above-described first embodiment.

Hereinafter, a configuration example of the warm-air heater 32 will be described. FIGS. 4A to 4D are enlarged diagrams (schematic diagrams) illustrating the periphery of the recording head 13 of FIG. 3. As illustrated in FIG. 4A as a side view, it is preferable that a blowing direction of warm air from the warm-air heater 32 be a direction away from the recording head 13. This configuration is to remove defects such as nozzle clogging by blowing air to the nozzles (not illustrated) of the recording head 13 or drying the ink. In the drawing, white blank arrows indicate blowing directions of the air (wand air) (the same shall be applied to the other drawings). Further, as illustrated in FIG. 4B which is a front view illustrating an A-A cross-section of FIG. 4A when seen in the arrow direction, the warm air is blown to the recording medium 2 in a direction not perpendicular but oblique to a carrying direction (X direction) of the recording medium 2. As a result, as illustrated in FIG. 4C as a bottom view, the warm air is blown from the recording head 13 to three directions (to the front, left, and right directions in the front view) which are directions away from the nozzle surface 13*a* of the recording head 13. According to the above-described configuration, an effect of supplying fresh air to the nozzle surface 13*a* of the recording head 13 in the X direction to prevent the temperature of the nozzles from being increased and an effect of preventing the nozzle surface 13*a* from being contaminated by the vapor of the solvent can be obtained. In addition, as illustrated in FIG. 4D as a schematic diagram, in order to accurately blow the warm air from the oblique direction to the recording medium 2, it is preferable that a rectifying structure such as a partition plate 32*b* capable of rectifying an air current be provided in a duct 32*a* to which the warm air is blown.

By providing the warm-air heater 32, not only an effect of preventing the surface temperature of ink droplets that land on the recording medium 2 from being decreased but an effect of removing the vapor of the solvent evaporated from the surfaces of the ink droplets to promote the evaporation can be obtained. However, when the surfaces of the ink droplets are dried, a coating film is formed on the surfaces, which inhibits the evaporation. Therefore, it is preferable that the flow rate of the warm air be controlled to match with the evaporation rate of the vapor supplied from the inside of the ink droplets to the surface.

Hereinafter, an example of a method of controlling the heating means using the controller 50 will be described.

As a characteristic configuration of the embodiment, the carriage heater 30 includes the infrared heater 31 and the warm-air heater 32. Accordingly, it can be considered that the temperature control of the carriage heater 30 is the same as that of the carriage heater 30 according to the first embodiment, except that both the infrared heater 31 and the warm-air heater 32 are controlled.

More specifically, it is preferable that drying conditions of the platen heater 20 be set to be fixed irrespective of an atmosphere temperature such as a room temperature. In this embodiment, for convenience of description, a case where only the print heater 21 is provided as the platen heater 20 will be described as an example. However, the description can be applied to a case where either or both of the pre-heater 22 and the post-heater 23 are further provided.

The carriage heater 30 has an effect of promoting the evaporation of the solvent in the ink and increasing the drying speed by rapidly heating the ink in which the surface temperature of the recording medium 2 is likely to be decreased by evaporation. However, excessive heating causes damages such as deformation of the recording medium 2 and thus needs to be avoided. In this case, when a heating temperature of the platen heater 20 alone is represented by T1, and when a temperature of the recording medium which is heated to be higher than T1 by a combination of the platen heater 20 and the carriage heater 30 (in this embodiment, the infrared heater 31 and the warm-air heater 32) is represented by ΔT2, a temperature T12 of the recording medium which is heated by a combination of the platen heater 20 and the carriage heater 30 (a temperature of the recording medium when ink droplets land on the recording medium 2) can be obtained from the following expression.

$$T12=T1+\Delta T2$$

In the embodiment, the heating temperature T12 of the recording medium 2 which is heated by the combination of the platen heater 20 and the carriage heater 30 is controlled to be substantially fixed irrespective of a room temperature Tr. According to this configuration, the recording medium can be completely dried irrespective of the room temperature Tr.

More specifically, first, the temperature T1 of the platen heater 20 (≅the temperature of the recording medium 2 immediately before being printed) is set to a fixed temperature which is determined based on a relationship between the type of the solvent of the ink and the heat-resistance of the recording medium 2 irrespective of the room temperature Tr. It is preferable that a value of T1 which is not affected by the room temperature Tr be sufficiently higher than the room temperature Tr. Therefore, the value of T1 is set to be in a range of, for example, T1=35 (° C.) to 80 (° C.). As the temperature T1 is increased, the drying speed of the recording medium 2 is increased. However, from the viewpoints of the heat-resistance of the recording medium 2, the safety of the operator, and energy saving, it is preferable that the temperature T1 be set to be as low as possible under conditions that the ink can be dried. In the embodiment, since the recording medium 2 is heated by the platen heater 20 and the carriage heater 30, it is preferable that T1 be set to a temperature which is higher than the temperature Tr by at least 20 (° C.) and is higher than ΔT2 by at least 10 (° C.), that is, T1=25 (° C.) to 60 (° C.). For example, it is preferable that the temperatures be set such that T1=40 (° C.), ΔT2=20 (° C.) to 30 (° C.), and T12=T1+ΔT2=60 (° C.) to 80 (° C.).

In this way, by setting the temperature T1 of the platen heater 20 (in the embodiment, the print heater 21) to be sufficiently higher than the room temperature Tr, defects can be solved. For example, even when the heating temperature is set based on the room temperature Tr, the drying speed does not change depending on the room temperature.

Further, it is preferable that the heating temperature ΔT2 of the carriage heater 30 (in the embodiment, the infrared heater 31 and the warm-air heater 32) be controlled to be changed depending on the recording speed on the recording medium 2 without being based on the room temperature Tr.

More specifically, it is preferable that ΔT2 be controlled to be changed depending on a change in an area velocity Vs which is determined based on a slide scanning speed Vy of the recording head 13 in the Y direction and a carrying speed Vx of the recording medium in the X direction. In the embodiment, when Vs is decreased, the heating time of the carriage heater 30 (the infrared heater 31 and the warm-air heater 32) is increased, and the recording medium 2 is damaged due to overheating. Conversely, when Vs is increased, ΔT2 is decreased along with a decrease in drying time, and the drying speed is decreased. Therefore, a configuration in which the carriage heater 30 is controlled depending on a recording mode, that is, depending on a recording speed, namely, a configuration in which either or both electric power for heating the infrared heater 31 and a temperature of the warm air of the warm-air heater 32 are controlled can be considered such that ΔT2 is in a range higher than a given value not to decrease the drying speed due to an increase in Vs and to increase the drying speed. According to an experiment by the present inventors, the value of ΔT2 is changed depending on the type of the main solvent (medium) of the ink, and a result of completely drying the ink can be obtained when the value of ΔT2 is selected in a range of 5(%) to 50(%) of a melting point value of the solvent. Accordingly, the value of ΔT2 is preferably in a range of 10(%) to 20(%).

According to the embodiment, by using the carriage heater 30 (the infrared heater 31 and the warm-air heater 32) and the platen heater 20, the above-described ink droplets that land on the surface of the recording medium 2 do not widely infiltrate into the recording medium 2 around ink-landing positions and can be rapidly dried without pausing in a state where the ink droplets are fixed onto the ink-landing positions in a small-diameter dot shape. Accordingly, clear diagrams or characters composed of plural ink dot arrays and having no smearing can be recorded on the surface of the recording medium 2.

Since other effects obtained in the embodiment are the same as those of the above-described first embodiment, the description thereof will not be repeated.

Third Embodiment

Next, an ink jet recording apparatus 1 according to a third embodiment of the present invention will be described.

The ink jet recording apparatus 1 according to the third embodiment has the same basic configuration as that of the ink jet recording apparatus 1 according to the second embodiment and has different points therefrom particularly in a configuration of the infrared heater 31 as the carriage heater 30. Hereinafter, the embodiment will be described focusing on the different points.

Figure 5A:
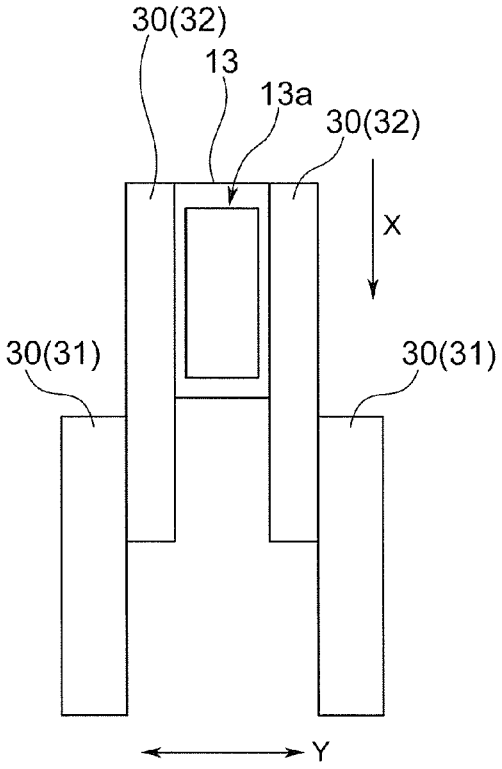
FIGS. 5A and 5B are schematic diagrams illustrating an example of an ink jet recording apparatus according to a third embodiment of the present invention.

As illustrated in FIG. 5A, in the embodiment, as the carriage heater 30 included in the heating means, two pairs of the infrared heaters 31 and the warm-air heaters 32 are provided. In the embodiment, unlike the above-described second embodiment, the infrared heaters 31 mounted on the carriage 14 are disposed to be distant from the recording head 13 in the moving direction (X direction in the drawing) of the recording medium 2. More specifically, the infrared heaters 31 are disposed on only a downstream side of the recording head 13 in the moving direction (X direction in the drawing) of the recording medium 2.

On the other hand, the warm-air heaters 32 mounted on the carriage 14 are disposed at front and rear positions of the recording head 13 in a reciprocating direction (Y direction in the drawing) of the carriage 14 to overlap with the recording head 13 in the moving direction (X direction in the drawing) of the recording medium 2.

A configuration in which only the infrared heater 31 is provided as the carriage heater 30 without providing the warm-air heater 32 can also be considered (not illustrated).

Figure 5B:
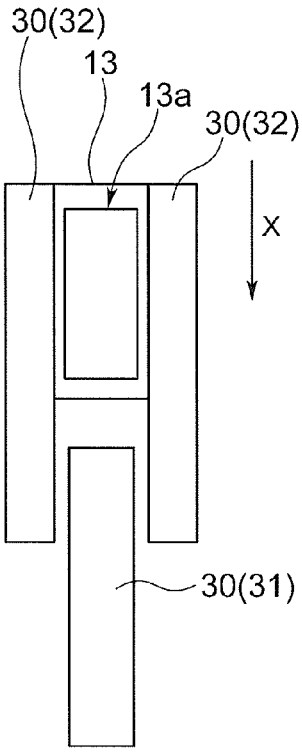

Hereinafter, FIG. 5B illustrates a modification example of the embodiment. As illustrated in FIG. 5B, a configuration can be considered in which one infrared heater 31 is disposed at a position which overlaps with the recording head 13 in the reciprocating direction (Y direction in the drawing) of the carriage 14 and is distant from the recording head 13 in the moving direction (X direction in the drawing) of the recording medium 2.

According to the above-described embodiment, the providing positions of the infrared heaters 31, in particular, are arranged not on both sides of a nozzle position (a position of the nozzle surface 13*a* in the drawing) of the recording head 13 in the Y-axis direction but on a downstream side of the nozzle position (the position of the nozzle surface 13*a* in the drawing) of the recording head 13 in the X direction to be distant from the nozzle position (with a clearance provided). Therefore, the effect of preventing the nozzles of the recording head 13 from being dried without decreasing a drying capability can be enhanced. In addition, since a heating region is widely secured, an effect of easily realizing complete drying conditions can also be obtained.

Since other effects obtained in the embodiment are the same as those of the above-described second embodiment, the description thereof will not be repeated.

Fourth Embodiment

Next, an ink jet recording apparatus 1 according to a fourth embodiment of the present invention will be described.

The ink jet recording apparatus 1 according to the fourth embodiment has the same basic configuration as that of the ink jet recording apparatus 1 according to the second embodiment and has different points therefrom particularly in a configuration of the infrared heater 31 as the carriage heater 30. Hereinafter, the embodiment will be described focusing on the different points.

Figure 6:
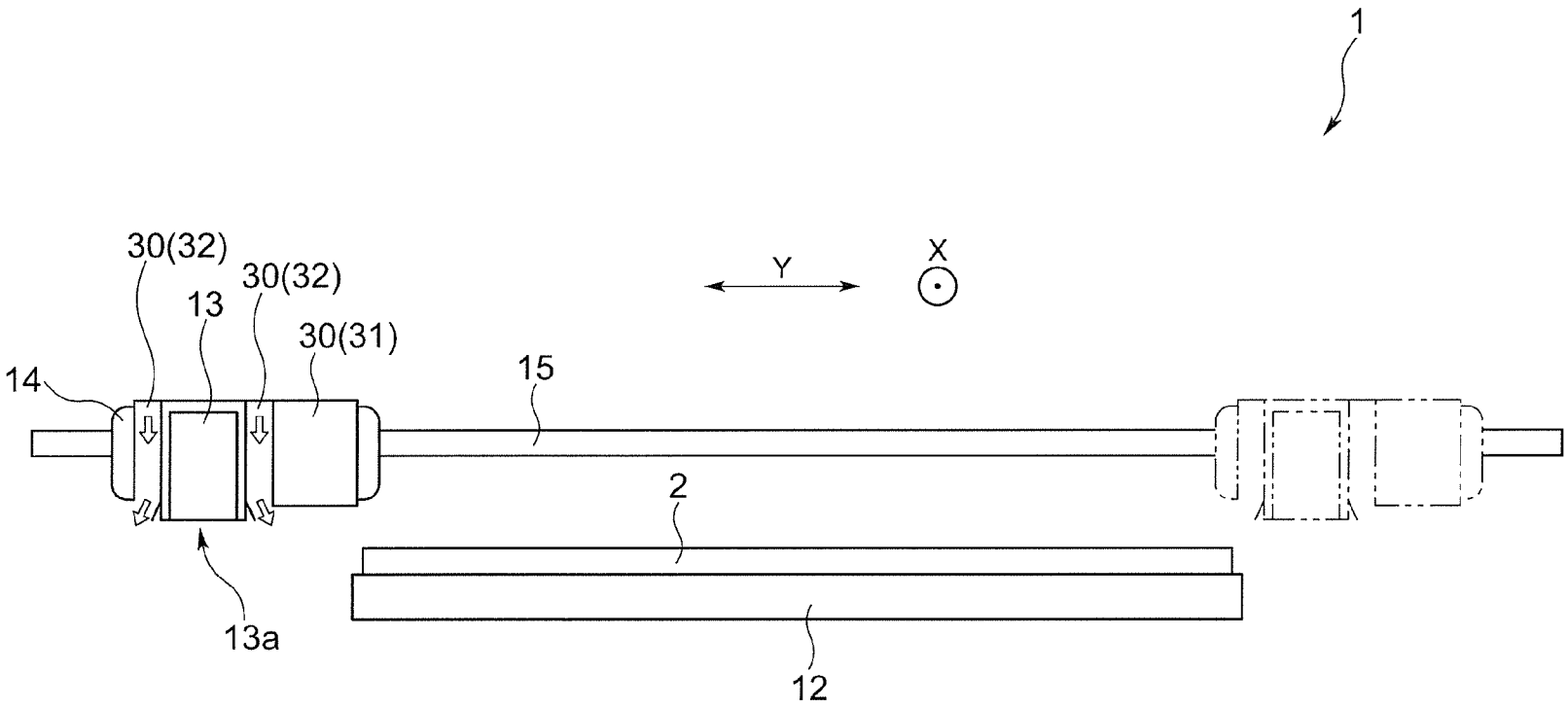
FIG. 6 is a schematic diagram illustrating an example of an ink jet recording apparatus according to a fourth embodiment of the present invention.

As illustrated in FIG. 6, in the embodiment, as the carriage heater 30 included in the heating means, the infrared heater 31 and the warm-air heaters 32 are provided. In the embodiment, unlike the above-described second embodiment, the infrared heater 31 mounted on the carriage 14 is provided at either a front position or a rear position of the recording head 13 in the reciprocating direction (Y direction in the drawing) of the carriage 14.

In the embodiment, the heating temperature of each heater is appropriately set such that a drying action of which a main object is to prevent the smearing of ink that lands on the recording medium 2 is caused by the platen heater 20 (print heater 21) and the warm-air heater 32 and a drying action of which a main object is to completely dry the ink is caused by the infrared heater 31.

According to this configuration, unlike the above-described second embodiment, the infrared heater 31 can be provided not on both sides but on only one side of the recording head 13. Therefore, the cost of the apparatus can be reduced. In addition, with the above-described configuration, the smearing of ink can be prevented, and the ink can be completely dried.

Since other effects obtained in the embodiment are the same as those of the above-described second embodiment, the description thereof will not be repeated.

Fifth Embodiment

Next, an ink jet recording apparatus 1 according to a fifth embodiment of the present invention will be described.

The ink jet recording apparatus 1 according to the fifth embodiment has the same basic configuration as that of the ink jet recording apparatus 1 according to the second embodiment and has different points therefrom particularly in a configuration of the carriage heater 30. Hereinafter, the embodiment will be described focusing on the different points.

Figure 7:
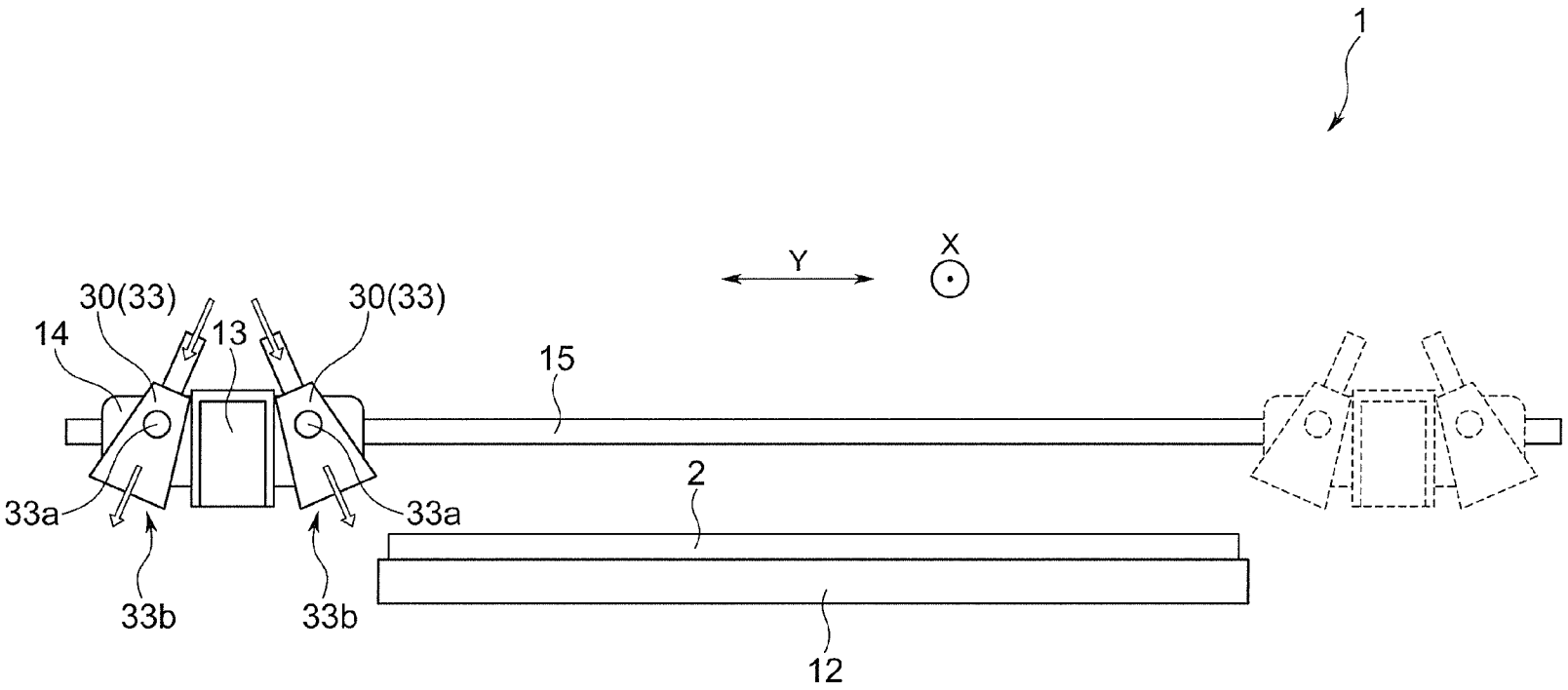
FIG. 7 is a schematic diagram illustrating an example of an ink jet recording apparatus according to a fifth embodiment of the present invention.

As illustrated in FIG. 7, in the embodiment, as the carriage heater 30 included in the heating means, an integrated heater 33 that irradiates infrared rays and blows warm air is provided.

More specifically, as illustrated in FIG. 7, the integrated heater 33 includes an infrared ray irradiating portion 33*a* therein to irradiate infrared rays from an opening 33*b* to the recording medium 2 on the platen 12. That is, the same effect as that of the infrared heater 31 according to the above-described second embodiment can be obtained.

Further, air is blown through the periphery of the infrared ray irradiating portion 33*a* and is blown out from the opening 33*b*. The infrared ray irradiating portion 33*a* radiates heat during the irradiation of infrared rays. Therefore, by blowing air through the periphery, the infrared ray irradiating portion 33*a* can be cooled, and warm air can be generated. By blowing the warm air from the opening 33*b* to the recording medium 2 on the platen 12, the same effect as that of the warm-air heater 32 according to the above-described second embodiment can be obtained.

According to this configuration, unlike the above-described second embodiment, it is not necessary that the infrared heater 31 and the warm-air heater 32 be separately provided as the carriage heater 30. Therefore, effects of reduction in the size and cost of the apparatus and energy saving can be achieved.

Since other effects obtained in the embodiment are the same as those of the above-described second embodiment, the description thereof will not be repeated.

As described above, according to the present invention, the recording medium can be heated such that the surface temperature of the recording medium directly below the recording head for discharging ink droplets onto the recording medium is in a range of 60 (° C.) to 80 (° C.). As a result, even in a case where an ink which is composed of an aqueous ink vehicle containing latex as a binder resin is used, ink that lands on the recording medium can be completely dried.

That is, the ink jet recording apparatus according to the present invention can provide drying conditions that can realize complete drying even when an image is recorded onto a recording medium which absorbs or does not absorb a solvent of an ink in a case where an ink having a low drying speed which cannot be sufficiently completely dried by heating a recording medium from a back surface thereof is used or a case where a recording speed is high and a drying time is short. In particular, with the configuration of providing the heating means on both a back surface and a recording surface of a recording medium, due to a synergic effect thereof, the smearing of ink that lands on the recording medium can be prevented, and the ink can be completely dried even in a case where a hard-to-dry ink is used, a case where a recording speed is high, or a case where a non-absorbent recording medium which is not coated with a coating agent as an ink absorbing layer is used.

Further, the heating of the carriage heater 30 can be weakened (the drying temperature at a printing area can be decreased). In addition, the internal temperature distribution of the landing ink droplets can be controlled to be high at a lower portion thereof and to be low at an upper portion thereof by relatively intensely heating the recording medium 2 from the lower side of the recording medium 2. Therefore, complete drying can be realized in printing in which the latex ink is used, and an effect capable of preventing the nozzles of the recording head 13 from being dried to suppress ink non-discharge can be obtained.

In addition, particularly, the following characteristic effects can be exhibited by the embodiments.

Disclosed is an ink jet recording apparatus 1 that prints an image onto a recording medium 2 using an ink which is composed of an aqueous ink vehicle containing latex as a binder resin, the ink jet recording apparatus 1 including: a carriage 14 on which a recording head 13 for discharging ink droplets onto the recording medium 2 is mounted and that moves relative to the recording medium 2; a platen 12 that supports the recording medium 2 at a predetermined position; and heating means for heating the recording medium 2. This heating means includes a platen heater 20 that is mounted on the platen 12 and heats the recording medium 2 from a lower side of the recording medium 2, a carriage heater 30 that is mounted on the carriage 14 and heats the recording medium 2 from an upper side of the recording medium 2, and an upper heater 34 that is disposed on a downstream side of the carriage 14 in a moving direction (X direction) of the recording medium 2 and heats the recording medium 2 from the upper side of the recording medium 2. According to this configuration, even in a case where an ink which is composed of an aqueous ink vehicle containing latex as a binder resin is used, the recording medium can be heated by the heating means such that the surface temperature of the recording medium 2 directly below the recording head 13 for discharging ink droplets is in a desired temperature range (for example, 60 (° C.) to 80 (° C.)). Therefore, the smearing of ink that lands on the recording medium 2 can be prevented and can be completely dried. The above-described effect can also be obtained in a case where a recording speed is high or a case where a non-absorbent recording medium which is not coated with a coating agent as an ink absorbing layer is used.

For example, when the recording medium 2 is heated by using only the heater (carriage heater 30) mounted on the carriage 14, the nozzles of the recording head 13 mounted on the carriage 14 are dried, which may cause ink non-discharge. Alternatively, when the recording medium 2 is heated by using only the heater (platen heater 20) mounted on the platen 12, cockling (rippling effect) or melting may occur depending on the type (material) of the recording medium 2. On the other hand, as in the configuration of the present invention, by heating the recording medium 2 from the upper and lower sides of the recording medium 2 using the three heaters (the platen heater 20, the carriage heater 30, and the upper heater 34), the heating temperature of each heater can be reduced. Therefore, the above-described problems, that is, ink non-discharge or defects (cockling or melting) of the recording medium can be solved.

More specifically, since the platen heater 20 and the upper heater 34 are provided, the heating of the carriage heater 30 can be set to be weak (that is, the drying temperature at a printing area can be set to be low). Further, a solvent can be smoothly moved to an ink surface by heating emulsion particles of the latex ink from a lower side thereof using the print heater 21. More specifically, since the internal temperature of the landing ink droplets is high at a lower portion thereof and is low at an upper portion thereof, the solvent inside the ink droplets can be smoothly moved from the lower portion to the upper portion. When the recording medium is heated by only the carriage heater 30, contrary to the above-described case, the internal temperature distribution of ink droplets is low at a lower portion thereof and is high at an upper portion thereof. Therefore, the solvent cannot be smoothly moved from the lower portion to the upper portion. Further, there may be a problem in that a coating film is likely to be formed on an ink surface. According to the present invention, in particular, a printed area of the recording medium 2 can be intensely heated by the upper heater 34. That is, since the intense heating at the printed area can be secured, the effect capable of weakening the heating of the carriage heater 30 (decreasing the drying temperature at the printed area) can be obtained. As a result, complete drying can be realized in printing in which the latex ink is used, and a remarkable effect capable of preventing the nozzles of the recording head 13 from being dried to suppress ink non-discharge can be obtained.

In addition, it is preferable that the ink jet recording apparatus further include a controller 50 that controls a heating temperature of the heating means, in which the controller 50 controls the heating means such that a surface temperature of the recording medium 2 directly below the recording head 13 is in a range of 60 (° C.) to 80 (° C.). According to this configuration, by heating the recording medium 2 from the upper and lower sides of the recording medium 2 using the three heaters (the platen heater 20, the carriage heater 30, and the upper heater 34), the heating temperature of each heater can be reduced. Therefore, the above-described problems, that is, ink non-discharge or defects (cockling or melting) of the recording medium 2 can be solved.

Specifically, by heating the surface of the recording medium 2, which is the printing surface, using the carriage heater 30 and the upper heater 34, the surface of the recording medium 2 can be efficiently heated compared to a case where the recording medium 2 is heated from the lower side of the recording medium 2 using only the platen heater 20. That is, by heating the recording medium 2 from the upper and lower sides of the recording medium 2 using the three heaters (the platen heater 20, the carriage heater 30, and the upper heater 34) such that the surface of the recording medium 2 is in a heating temperature range of 60 (° C.) to 80 (° C.). As a result, the heating temperature of each heater can be reduced, and thus, particularly, defects (cockling or melting) of the recording medium 2 can be efficiently prevented.

In addition, it is preferable that a vinyl chloride-based film which is not coated with a coating agent as an ink absorbing layer be used in the recording medium 2. The reason is that the vinyl chloride-based film has a problem in that the normal heat-resistant temperature is lower than that of other films (for example, PET). More specifically, for example, when the recording medium is heated by using only the platen heater, there is a problem in that cockling (rippling effect) or melting is likely to occur. On the other hand, as in the above-described configuration, by heating the recording medium 2 from the lower and upper sides of the recording medium 2 using the three heaters (the platen heater 20, the carriage heater 30, and the upper heater 34), the heating temperature of each heater can be reduced. Therefore, problems such as defects (cockling or melting) of the recording medium 2 can be solved, and the vinyl chloride-based film can be used. Accordingly, choices of a material which can be used as the recording medium 2 can be increased. In addition, since the recording medium 2 in which an ink absorbing layer is not provided can be used, the cost can be reduced.

In addition, it is preferable that the platen heater 20 include at least one of a print heater 21 that is disposed directly below the recording head 13, a pre-heater 22 that is disposed on an upstream side of the print heater 21 in the moving direction (X direction) of the recording medium 2, and a post-heater 23 that is disposed on a downstream side of the print heater 21 in the moving direction (X direction) of the recording medium 2. According to this configuration, for example, when the pre-heater 22 is provided, the recording medium 2 can be pre-heated by the pre-heater 22. Therefore, even when an image is printed at a low room temperature or at a high speed, an effect in which it is not necessary to increase the temperature of the heaters (that is, the print heater 21 and the carriage heater 30) at a printing area can be obtained. In addition, for example, when a post-heater 23 is provided, the recording medium 2 can be heated by the post-heater 23 after printing. Therefore, an effect in which it is not necessary to increase the temperature of the heaters (that is, the print heater 21 and the carriage heater 30) at a printing area can be obtained.

The present invention is not limited to the above-described embodiments, and various modifications can be made within a range not departing from the scope of the present invention. In particular, as the ink to be used, the ink which is composed of an aqueous ink vehicle containing latex as a binder resin and having a moisture content of 35 (wt %) or greater has been described as an example. However, the present invention is not limited to this configuration and can also be applied to other inks.

The invention claimed is:

1. An ink jet recording apparatus that prints an image onto a recording medium using an ink which is composed of an aqueous ink vehicle containing latex as a binder resin, the ink jet recording apparatus comprising:

a carriage on which a recording head for discharging ink droplets onto the recording medium is mounted and that moves relative to the recording medium;

a platen that supports the recording medium at a predetermined position;

a heating means for heating the recording medium; and a controller that controls a heating temperature of the heating means, wherein the heating means includes:

a platen heater that is mounted on the platen and heats the recording medium from a lower side of the recording medium, wherein the platen heater is disposed directly below the recording head, a carriage heater that is mounted on the carriage and heats the recording medium from an upper side of the recording medium, and an upper heater that is disposed on a downstream side of the carriage in a moving direction of the recording medium and heats the recording medium from the upper side of the recording medium, wherein the upper heater heats the recording medium with a stronger heating than the heating of carriage heater, and the platen heater heats the recording medium with a stronger heating than the heating of the carriage heater, wherein the controller controls the heating means such that a surface temperature of the recording medium directly below the recording head is in a range of 60° C. to 80° C., and an ink droplet landed on the recording medium is heated by the platen heater, and an internal temperature distribution of the ink droplet is controlled to be high at a lower portion of the ink droplet, and is controlled to be low at an upper portion of the ink droplet.

2. The ink jet recording apparatus according to claim 1, wherein a vinyl chloride-based film which is not coated with a coating agent as an ink absorbing layer is used in the recording medium.

3. The ink jet recording apparatus according to claim 1, further comprising:

at least one of a pre-heater that is disposed on an upstream side of the print heater in the moving direction of the recording medium, and a post-heater that is disposed on a downstream side of the print heater in the moving direction of the recording medium.

4. A control method of a heating means of an ink jet recording apparatus that prints an image onto a recording medium using an ink which is composed of an aqueous ink vehicle containing latex as a binder resin, the ink jet recording apparatus includes: a carriage on which a recording head for discharging ink droplets onto the recording medium is mounted and that moves relative to the recording medium; a platen that supports the recording medium at a predetermined position; a heating means for heating the recording medium; and a controller that controls a heating temperature of the heating means, wherein the heating means includes: a platen heater that is mounted on the platen and heats the recording medium from a lower side of the recording medium, wherein the platen heater is disposed directly below the recording head, a carriage heater that is mounted on the carriage and heats the recording medium from an upper side of the recording medium, and an upper heater that is disposed on a downstream side of the carriage in a moving direction of the recording medium and heats the recording medium from the upper side of the recording medium, wherein the upper heater heats the recording medium with a stronger heating than the heating of the carriage heater, and the platen heater heats the recording medium with a stronger heating than the heating of the carriage heater, wherein the controller controls the heating means such that a surface temperature of the recording medium directly below the recording head is in a range of 60° C. to 80° C., and an ink droplet landed on the recording medium is heated by the platen heater, and an internal temperature distribution of the ink droplet is controlled to be high at a lower portion of the ink droplet, and is controlled to be low at an upper portion of the ink droplet;

wherein the control method comprises:

a heating temperature of the carriage heater is controlled to be changed depending on a recording speed on the recording medium.

* * * * *